US007131844B1

(12) United States Patent
Wurr

(10) Patent No.: US 7,131,844 B1
(45) Date of Patent: Nov. 7, 2006

(54) COLLECTOR RING ASSEMBLY

(75) Inventor: Robert C. Wurr, Harlan, IA (US)

(73) Assignee: Insul-8 Corporation, Omaha, NE (US)

( * ) Notice: Subject to any disclaimer, the term of this patent is extended or adjusted under 35 U.S.C. 154(b) by 0 days.

(21) Appl. No.: 11/311,606

(22) Filed: Dec. 19, 2005

(51) Int. Cl.
*H01R 39/00* (2006.01)

(52) U.S. Cl. ..... 439/20; 439/24

(58) Field of Classification Search ..... 439/20, 439/21, 22, 23, 24
See application file for complete search history.

(56) References Cited

U.S. PATENT DOCUMENTS 2,645,759 A * 7/1953 Solari ..... 439/22
3,193,636 A * 7/1965 Daniels ..... 200/51.12
3,439,307 A * 4/1969 Ruscher ..... 439/21
3,659,627 A 5/1972 Zimmerer et al. ..... 137/344
5,409,403 A * 4/1995 Falossi et al. ..... 439/668
5,425,645 A * 6/1995 Skovdal et al. ..... 439/23
5,734,218 A 3/1998 Crockett et al. ..... 310/232
5,901,429 A 5/1999 Crockett ..... 29/597
5,977,681 A 11/1999 Retzlaff ..... 310/219
6,576,852 B1 * 6/2003 Shu ..... 200/51 R
6,664,697 B1 12/2003 Bowman ..... 310/232
6,789,653 B1 * 9/2004 Hsu et al. ..... 191/12.2 R

* cited by examiner

*Primary Examiner*—Hae Moon Hyeon
(74) *Attorney, Agent, or Firm*—Thomte, Mazour & Niebergall; Dennis L. Thomte

(57) ABSTRACT

A collector ring comprising a non-electrically conductive, non-rotatable slip ring base having a plurality of slip rings mounted thereon with the slip rings decreasing in diameter from the lower end of the base to the upper end of the base. Electrical wires are secured to the slip rings and extend therefrom for connection to a source of power. A slip ring brush holder is rotatably secured to the slip ring base and has a plurality of brush holders mounted thereon which engage the slip rings on the base. Electrical wires extend from the brushes outwardly from the brush holder.

3 Claims, 7 Drawing Sheets

COLLECTOR RING ASSEMBLY

BACKGROUND OF THE INVENTION

1. Field of the Invention

This invention relates to a collector ring assembly and more particularly to a small collector ring assembly which is easier to assemble than conventional collector ring assemblies and which has a smaller number of parts than conventional collector ring assemblies.

2. Description of the Related Art

Collector ring assemblies, sometimes called slip ring assemblies, are commonly used to permit the supply of electrical power from a stationary component to a rotatable component. Collector rings are extensively used on cranes, center pivot irrigation machines and on electrical cable reels. The electrical cable reels normally utilize a relatively small collector ring assembly to permit electrical power to be transmitted from a non-rotatable hub to a rotatable reel. Even though the conventional collector rings used on cable reels are small, they have a large number of parts which may be difficult to fabricate and assemble.

SUMMARY OF THE INVENTION

A collector ring assembly is disclosed which ideally suited for use with a cable reel but which may have application on other components for the transmission of power from a stationary member to a rotatable member. The collector ring assembly comprises a non-electrically conductive, non-rotatable slip ring base having an outer surface, an upper end, and a lower end. The outer surface of the slip ring base has a generally truncated-conical shape defining a plurality of annular shoulders which are vertically and horizontally spaced-apart with respect to one another. The annular shoulders progressively decrease in diameter from the lower end of the base to the upper end of the base. A ring-shaped, electrically conductive slip ring is positioned on each of the annular shoulders with the slip rings having upper and lower ends. Electrical wires are secured to the slip rings and extend downwardly therefrom through the slip ring base for connection to a source of electrical power. A slip ring brush holder rotatably embraces the slip ring base. A plurality of slip ring brushes are positioned between the slip ring brush holder and the base and are rotatable with the brush holder. The brushes are in electrical contact with the upper ends of the slip rings. Electrical wires are connected to the slip ring brushes and extend therefrom through the slip ring brush holder for connection to a structure which is rotatable with respect to the slip ring base. Although it is described that the slip ring base is non-rotatable and the slip ring brush holder is rotatable, the same could be reversed, i.e., the slip ring base may be rotatably mounted while the slip ring brush holder is stationary.

It is therefore a principal object of the invention to provide a collector ring assembly which is comprised of a smaller number of parts than conventional collector ring assemblies.

A further object of the invention is to provide a collector ring assembly which is easier to fabricate and assemble than conventional collector ring assemblies.

Still another object of the invention is to provide a collector ring assembly which is ideally suited for use with an electrical cord reel.

These and other objects will be apparent to those skilled in the art.

DETAILED DESCRIPTION OF THE INVENTION

The numeral 10 refers generally to the collector ring or slip ring assembly of this invention which is comprised generally of two main components, that is, a slip ring base 12 and a slip ring brush holder 14. In the following description, base 12 will be described as being non-rotatable with the brush holder 14 being rotatable with respect to the base 12. However, as previously stated, the brush holder 14 could be the stationary component with the base 12 being the rotatable component if so desired. Further, for purposes of description, although the base 12 and the brush holder 14 will be described as having upper and lower ends, it should be understood that the collector ring assembly could be turned upside down or positioned on its side. Thus, "upper" and "lower" are only used herein for purposes of description and should not be deemed as being limiting.

Figure 5:
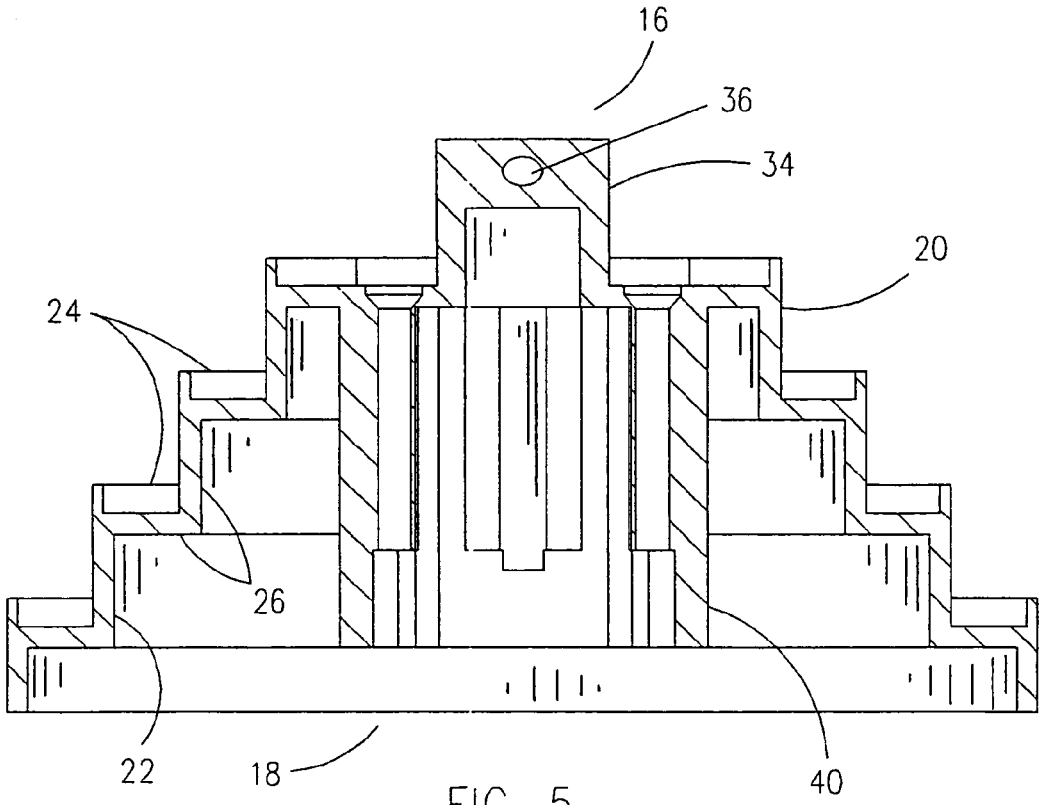
FIG. 5 is a sectional view of the base of the collector ring which is at right angles to the sectional view of FIG. 4.
Figure 6:
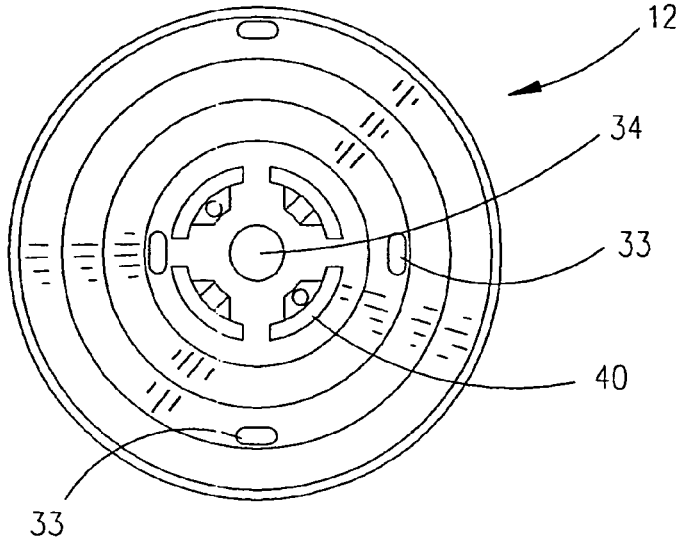
FIG. 6 is a bottom view of the base.
Figure 7:
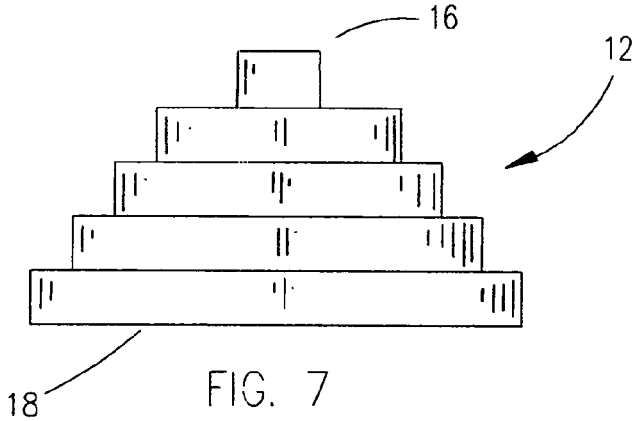
FIG. 7 is a side view of the base.
Figure 8:
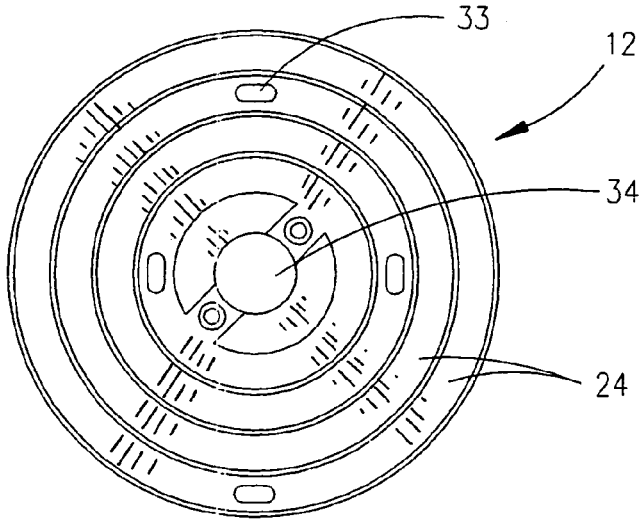
FIG. 8 is a top view of the base.
Figure 10:
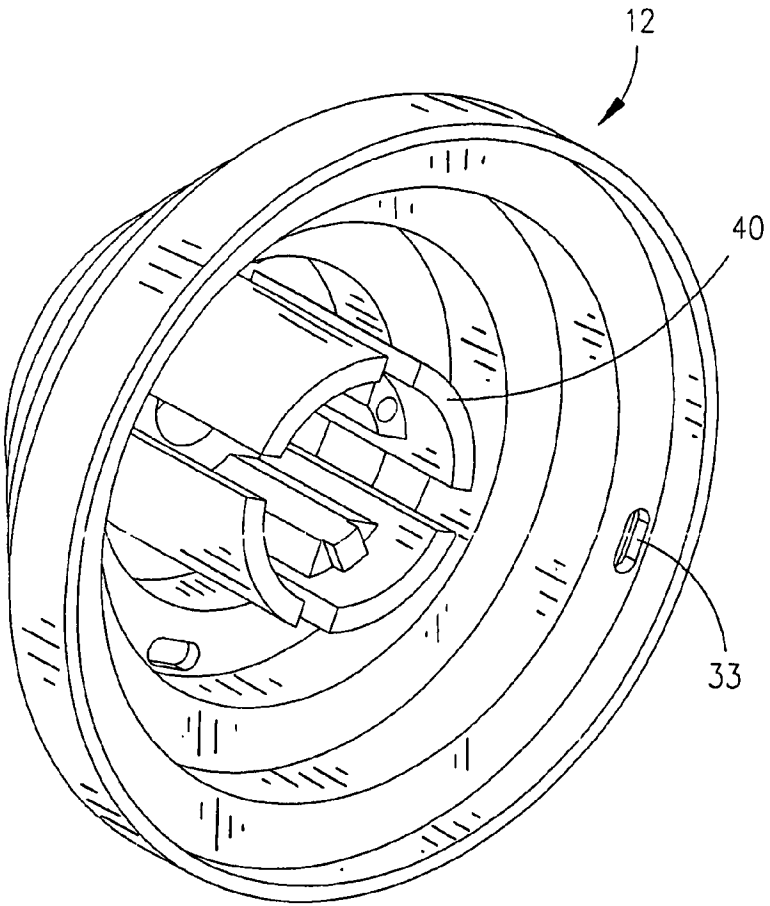
FIG. 10 is a bottom perspective view of the base.
Figure 9:
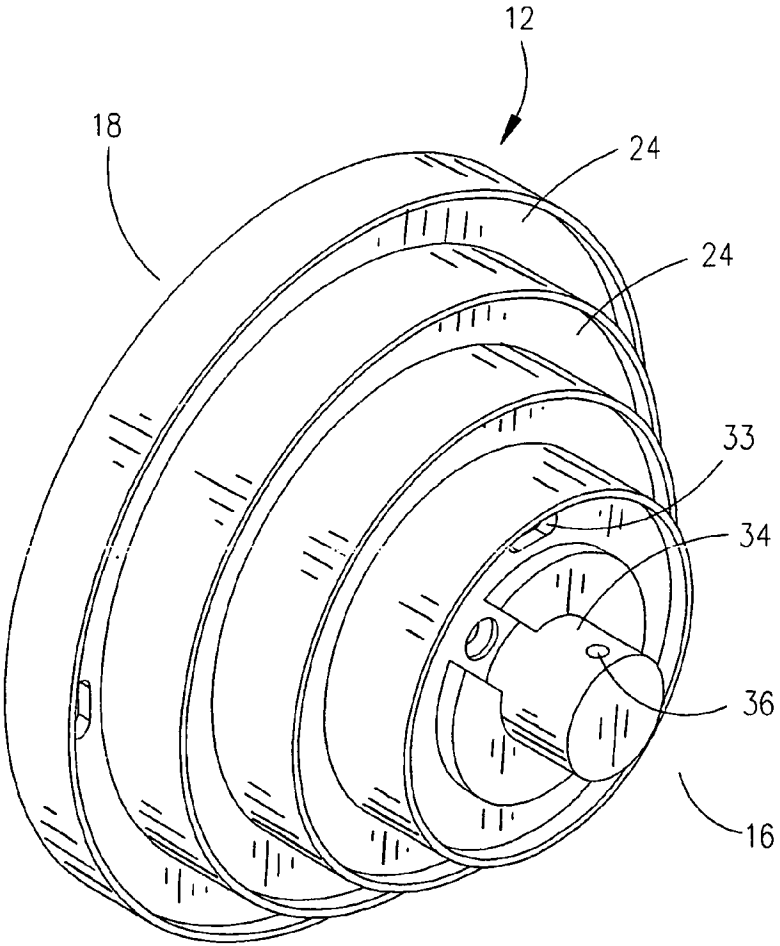
FIG. 9 is a top perspective view of the base.

For purposes of description, base 12 has an upper end 16, lower end 18, an outer surface 20 and an inner surface 22. Outer surface 20 of base 12 is provided with a plurality of ring-shaped or annular-shaped recessed steps or shoulders 24 which have progressively decreasing diameters from the lower end of the base 12 to the upper end of the base 12. The outer surface 20 of base 12 generally defines a truncated-conical shape. The inner surface 22 of base 12 is also provided with a plurality of steps or shoulders 26 so that the inner surface of base 12 also has a generally truncated-conical shape, as best seen in FIGS. 5 and 6.

A flat, annular slip ring 28 is positioned in each of the recessed shoulders 24 in an embedded fashion and is secured therein by any convenient means. The uppermost slip ring 28 is secured to the upper end of the base 12 by screws 30. Electrical wires 32 are electrically connected at their upper ends to the underside of the slip rings 28 and extend downwardly through openings 33 formed in base 12. If there are four slip rings utilized, base 12 will be provided with four of the openings 33 to permit the electrical wires 32 to extend downwardly therethrough. The base member 12 is electrically non-conductive while the slip rings 28 are comprised of electrically conductive material. Base 12 is provided with an upstanding cylindrical hub 34 having a bore 36 extending transversely therethrough which is adapted to receive a pin 38 therein as will be described in more detail hereinafter. The inner surface 22 of base 12 is provided with a downwardly extending split tube 40.

Brush holder 14 includes a base portion 42 and downwardly and outwardly depending legs 44 and 46. The inner surface of leg 44 is provided with rectangular openings 48 and 50 extending upwardly thereinto which are adapted to receive a slip ring brush 52 therein. The upper ends of openings 48 and 50 are provided with bores 54 and 56 extending therefrom for a purpose to be described hereinafter.

Figure 12:
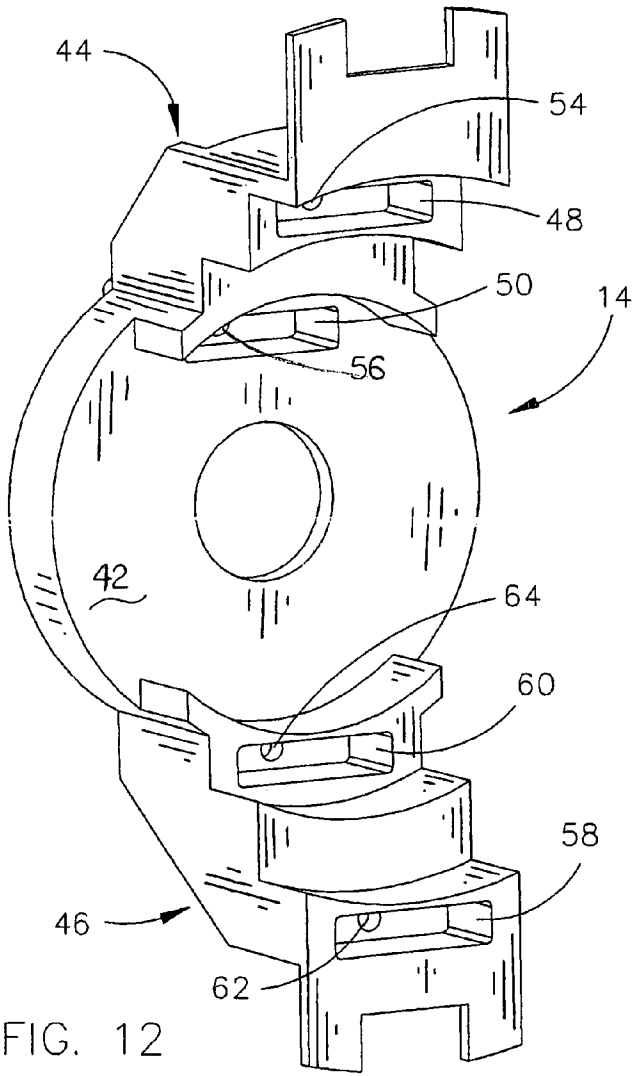
FIG. 12 is a bottom perspective view of the brush holder.
Figure 11:
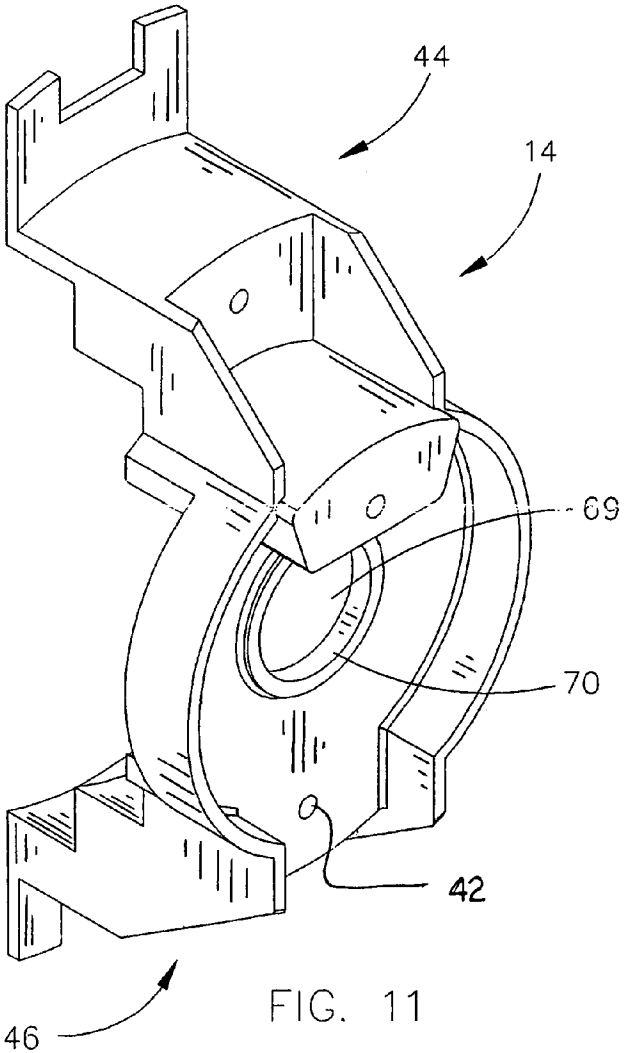
FIG. 11 is a top perspective view of the brush holder.
Figure 13:
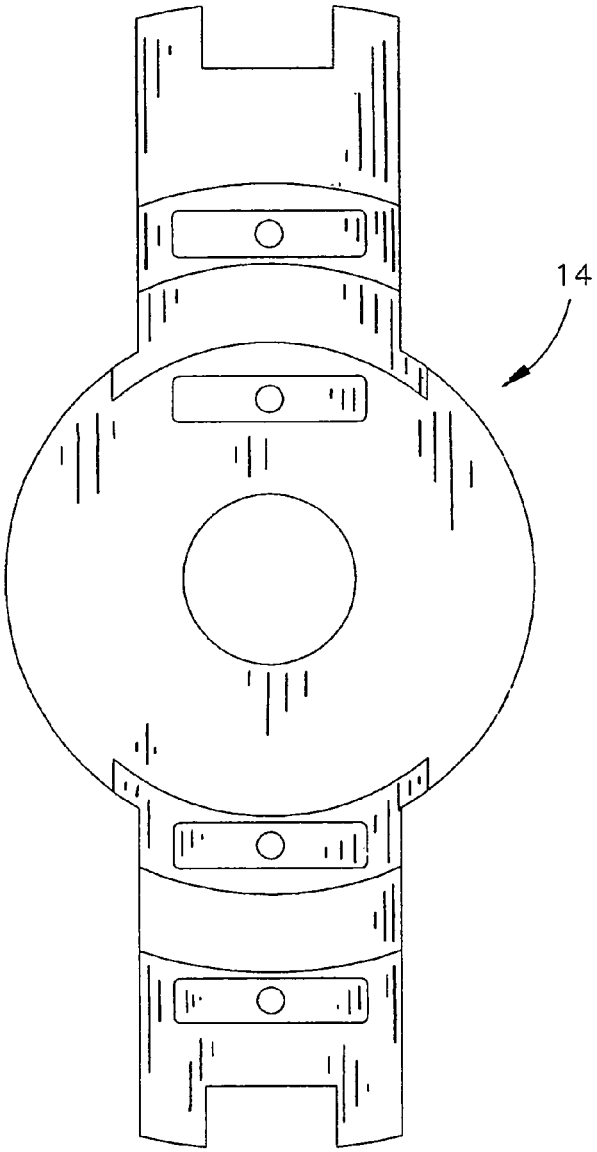
FIG. 13 is a bottom view of the brush holder.
Figure 14:
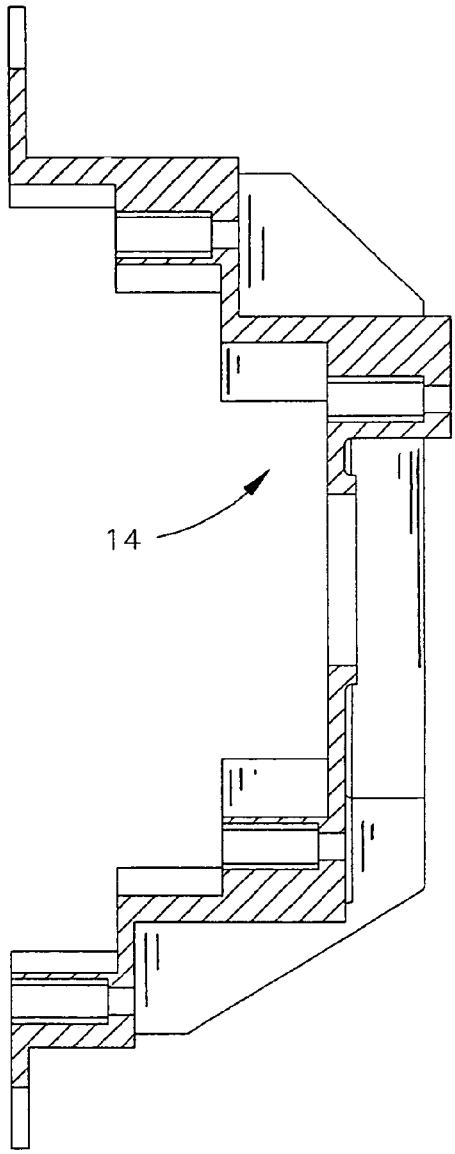
FIG. 14 is a sectional view of the brush holder.

Similarly, leg 46 is provided with rectangular openings 58 and 60 formed therein, as best seen in FIG. 12, each of which are adapted to receive a slip ring brush 52 therein. Bores 62 and 64 extend upwardly from the openings 58 and 60, respectively, to permit electrical wires to be extended therethrough. The brush openings 48, 50, 58 and 60 are arranged so that the lower ends thereof will be positioned over one of the slip rings 28. If there are four slip rings utilized in the assembly, opening 50 will be positioned above the uppermost slip ring 28, opening 60 will be positioned over the next highest slip ring 28, opening 48 will be positioned over the next highest slip ring 28 and opening 58 will be positioned over the lowest slip ring 28.

Figure 1:
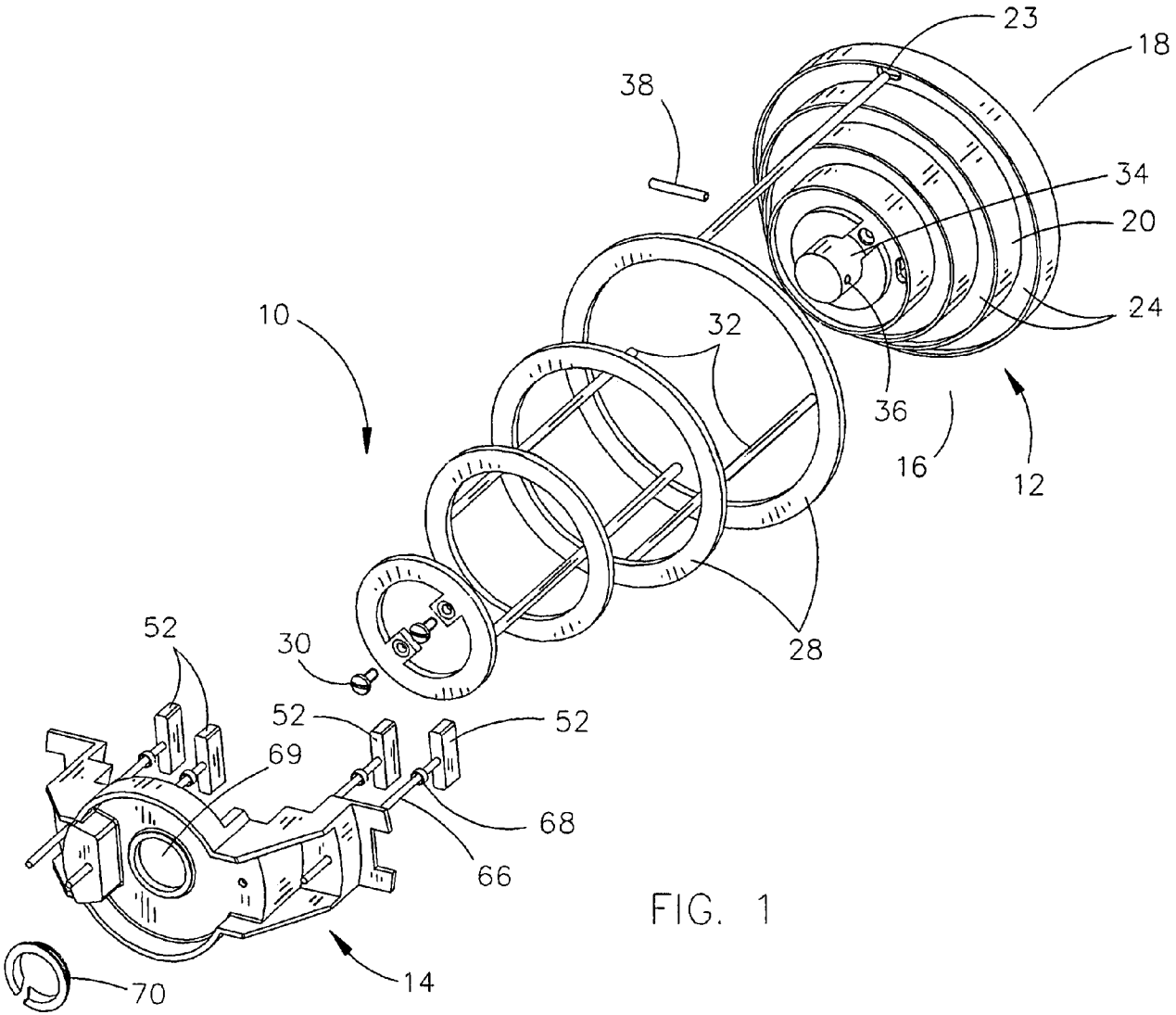
FIG. 1 is an exploded perspective view of the collector ring assembly of this invention.
Figure 2:
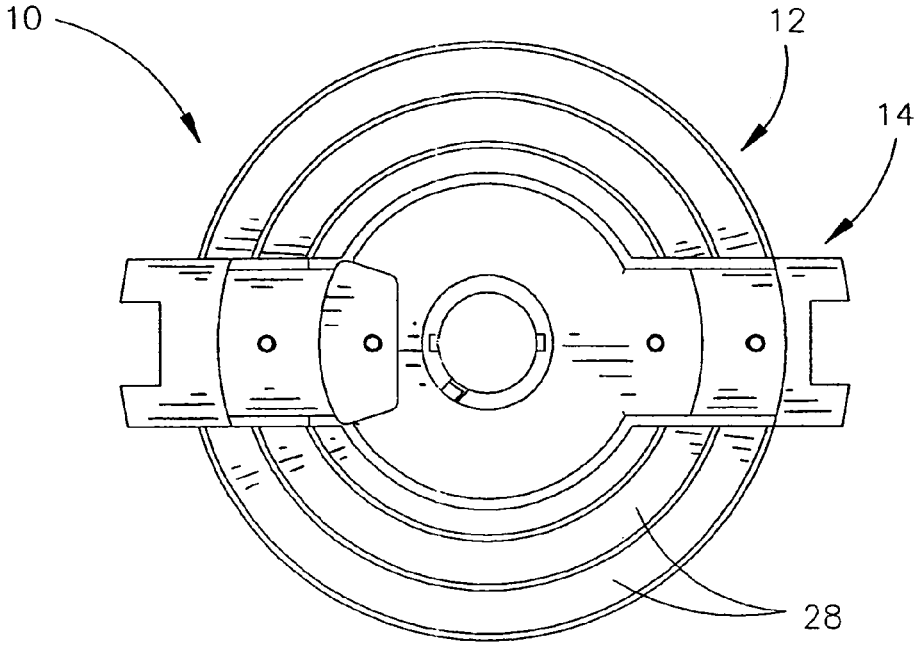
FIG. 2 is a top view of the collector ring assembly of this invention.
Figure 3:
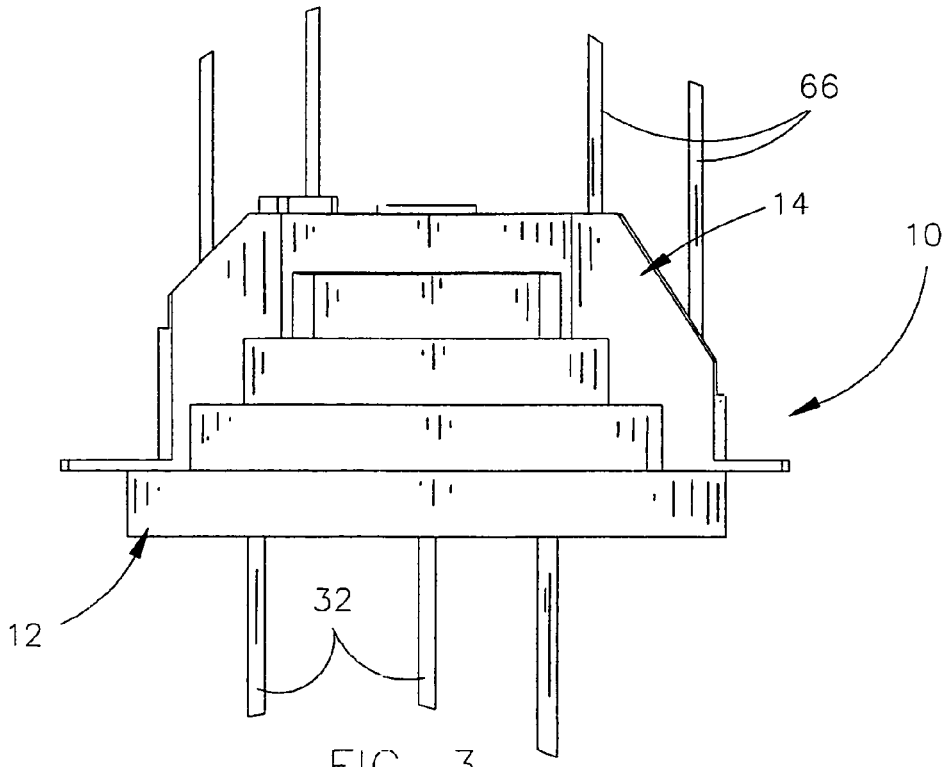
FIG. 3 is a side view of the collector ring assembly of this invention.
Figure 4:
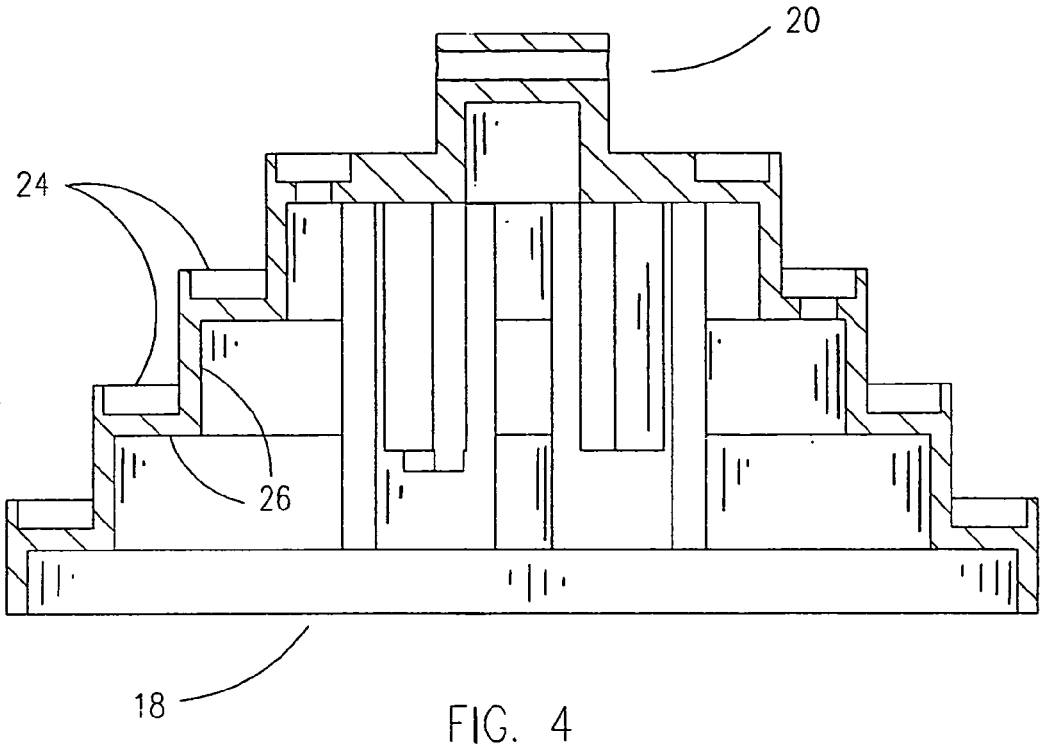
FIG. 4 is a sectional view of the base of the collector ring.

As seen in FIG. 1, semi-rigid electrical wires 66 are connected to the brushes 52 and extend upwardly through the openings 54 in brush holder 14. Coil springs 68 are mounted on the wires 66 in association with each of the wiper brushes 52 to yieldably urge the wiper brushes into frictional engagement with the upper surfaces of the slip rings 28.

Base portion 42 of brush holder 14 is provided with a central opening 69 which receives hub 34 therein with a bearing 70 being positioned therebetween. The brush holder 14 is maintained on the base 12 by means of pin 38 extending through bore 36 above base portion 42.

Thus it can be seen that a collector ring assembly has been provided which is fabricated from relatively few parts and which is easily assembled. Once assembled, assuming that base 12 is the stationary component, brush holder 14 will rotate with respect thereto. However, as previously stated, it may be that in certain situations brush holder 14 will be the stationary part and base 12 will rotate with respect thereto. At any rate, the springs 68 urge the brushes 52 into electrical contact with the slip rings 28. Electrical power is supplied to the slip rings 28 by the wires 32 which are connected to a source of electrical power. Electrical power is transferred from the slip rings 28 through the brushes 52 and through the wires 66 to the rotatable component.

It can therefore be seen that the collector ring assembly of this invention accomplishes at least all of its stated objectives.

I claim:

1. A collector ring assembly, comprising:

a non-electrically conductive, non-rotatable slip ring base having an outer surface, an upper end and a lower end;

said outer surface of said slip ring base having a generally truncated-conical shape having a plurality of flat annular shoulders which are vertically and horizontally spaced-apart with respect to one another;

said annular shoulders progressively decreasing in diameter from said lower end of said base to said upper end of said base;

a flat, annular electrically conductive slip ring positioned on each of said annular shoulders;

said slip rings having upper and lower surfaces;

electrical wires secured to said slip rings and extending downwardly therefrom through said slip ring base;

a non-electrically conductive slip ring brush holder rotatably secured to said slip ring base;

a plurality of slip ring brushes positioned between said slip ring brush holder and said base and being rotatable therewith;

said brushes being in electrical contact with said slip rings;

electrical wires connected to said brushes and extending therefrom through said brush holder.

2. The assembly of claim 1 wherein said brushes are vertically movably mounted in said brush holder and are yieldably urged into electrical contact with said slip rings.

3. The assembly of claim 1 wherein said slip rings are embedded in said shoulders of said slip ring base.

* * * * *